US008608334B2

(12) United States Patent
Sanders

(10) Patent No.: US 8,608,334 B2
(45) Date of Patent: Dec. 17, 2013

(54) DEVICE FOR DISPLAYING AND ILLUMINATING AN IMAGE

(75) Inventor: Gerald R. Sanders, Oakley, UT (US)

(73) Assignee: Lightheaded Ventures, LLC, Park City, UT (US)

( * ) Notice: Subject to any disclaimer, the term of this patent is extended or adjusted under 35 U.S.C. 154(b) by 0 days.

(21) Appl. No.: 13/523,803

(22) Filed: Jun. 14, 2012

(65) Prior Publication Data

US 2012/0320622 A1 Dec. 20, 2012

Related U.S. Application Data

(60) Provisional application No. 61/496,997, filed on Jun. 14, 2011.

(51) Int. Cl.
*F21V 33/00* (2006.01)

(52) U.S. Cl.
USPC ..... 362/127; 362/568; 362/97.4

(58) Field of Classification Search
USPC ..... 362/33, 97.1, 97.4, 127–134, 568
See application file for complete search history.

(56) References Cited

U.S. PATENT DOCUMENTS 2,257,005 A * 9/1941 Grosse ..... 108/23
3,811,212 A * 5/1974 Wright ..... 40/367
5,149,568 A 9/1992 Beck
5,657,563 A * 8/1997 Lane ..... 40/219
5,736,686 A * 4/1998 Perret et al. ..... 178/18.11
6,393,401 B1 5/2002 Loudermilk et al.
7,107,712 B2 9/2006 Mueller
7,221,488 B2 5/2007 Khovaylo et al.
7,281,834 B2 10/2007 Sinofsky
2010/0319227 A1 12/2010 Sanders

OTHER PUBLICATIONS

International Search Report and Written Opinion mailed Feb. 27, 2013 in related PCT Application No. PCT/US2012/042356.

* cited by examiner

*Primary Examiner* — Laura Tso
(74) *Attorney, Agent, or Firm* — Maschoff Brennan

(57) ABSTRACT

Some embodiments may include a device for displaying and illuminating images. The device may include a housing including an interior portion. An opening in the housing may provide access to the interior portion. A viewing aperture may be formed in the housing. The device may include a light guide having a light source. The light guide may be removably received within the housing via the opening. The device may include a graphic medium with an image printed thereon. The graphic medium may be removeably received within the housing via the opening and guided via a guide surface disposed on a portion of the light guide. The graphic medium may be guided via the guide surface and positioned with respect to the light guide such that at least a portion of the image is viewable through the aperture and at least partially illuminated via light originating from the light source.

20 Claims, 11 Drawing Sheets

222
248
216
244
250
234
240
104c
220
233
242
246
236
230
238
232
224
252

220
104c
222
200
2C
2C
108
217
110
106
Fast Freddy LaMont
INDY 500

DEVICE FOR DISPLAYING AND ILLUMINATING AN IMAGE

CROSS-REFERENCE TO RELATED APPLICATIONS

The patent application claims priority to U.S. Provisional Patent Application 61/496,997 filed Jun. 14, 2011, which is incorporated herein by reference.

FIELD

The present disclosure relates generally to devices for illuminating images. In some embodiments, illuminated images may be framed independently for wall hanging or display on a stand, or incorporated within or attached to furniture.

BACKGROUND

Framed images are often placed on walls and on top of furnishings. For example, artwork may be placed on a wall, a family photograph may be placed on a desk, and the like. These images may ordinarily be unlit, or lit by a light located on the same side of the image as the viewer. Nevertheless, there may be some instances where a backlit image is desired. Devices that may allow the display of a backlit image may be available. However, changing the image in these devices may be difficult and the devices themselves may not be suitable for all applications.

SUMMARY

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Disclosed embodiments are directed to systems providing for backlighting or illumination of images that might be provided on a transparent media. Advantageously, disclosed systems eliminate the need for incorporated framing and yet permit incorporation of controls for dimming the illumination and for timed dimming and on/off operation of the backlighting. Major components of the system, for example a light guide (and/or light guide panel), the image (such as might be provided on a transparency), and a protective cover (such as an acrylic sheet), are independently removable to facilitate changing of the image and to allow the system to be easily serviced and/or repaired.

Disclosed embodiments provide a number of other potential advantages as well. For example, a disclosed light guide provides a guide surface to assist the insertion and/or removal of the graphic medium. In addition, the guide surface maintains an electrostatic "break" or air gap as between removable elements (such as the graphic image and protective sheet) to minimize electrostatic binding of plastic components upon insertion or removal. In addition, disclosed implementations of a light guide incorporate thermal management features so as to manage and remove heat generated by light source (such as light emitting diodes LED) within an enclosure. In addition, a light guide may provide a housing that, in addition to retaining and appropriately positioning a light source, provides electrical power connection for the light source including wiring management that facilitates light guide removal, and incorporates controller electronics providing functions such as dimmer and timing for the light source as well as wireless remote control functionality. The light source may be controlled remotely and/or controlled by a panel physically connected to the light guide. Some of these and/or other features and advantages of disclosed embodiments may allow the illuminated images to be incorporated into applications that may have been impractical previously, including but not limited to, furniture, including children's beds, and other commercial and residential applications such as under-cabinet and under-counter lighting systems.

Some embodiments include a device for displaying and illuminating images. The device may include a housing including an interior portion. Access is provided to the interior portion via an opening formed in the housing. In disclosed embodiments, the device further includes a light guide, which includes a light source and a guide surface disposed on a portion of the light guide. The light guide is configured to be removably received within the housing via the opening. The device also includes an image imprinted on a graphic medium. The graphic medium is configured to be removeably received within the housing via the opening and guided via the guide surface of the light guide. The guide surface is configured to guide the graphic medium to a position wherein at least a portion of the image is viewable through an aperture formed in the housing, and at least a portion of the image is at least partially illuminated via light originating from the removable light source.

Some embodiments contemplate the integration of the above device within an article of furniture. For example, the article of furniture may include a housing having an interior portion, which is accessible via an opening formed along a portion of the housing. An image imprinted on a graphic medium is configured to be received within the housing via the opening, and such that at least a portion of the image is viewable through an aperture formed in the housing. A light guide having multiple light emitting devices, and a light guide panel configured to direct light from the multiple light emitting devices onto the image is provided. In example embodiments, the light guide is configured to be removably received within the housing via the opening, and is configured to define a guide surface. The guide surface is oriented to guide the graphic medium within the housing and retain the graphic medium in a predetermined position and orientation within the housing. The guide surface may be further configured to provide a space between at least a portion of the graphic medium and the light guide panel.

Disclosed example embodiments pertain to a light guiding device, which may be used in combination with a substantially planar light guide panel. The light guiding device includes a light guide having a light source positioned so as to direct light to the light guide panel for illumination of an image. The light guide may further include a guiding structure. The guiding structure may include a guide surface configured to retain the light guide panel at a position that is at least partially offset from the image.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DESCRIPTION OF EMBODIMENTS

Available devices that allow the illumination and display of a changeable image may not be suitable for many applications. For example, changing the image in these devices is often difficult, particularly to someone who has not had practice or training in changing the image. In some instances, electrostatic attraction between a graphic medium including the image and one or more parts of the device may contribute to the difficulty in changing the image. In some instances, when an image is difficult to change, the graphic medium may be damaged or destroyed, increasing the cost—and frustration—associated with the device. Available devices may further produce undesirably heated surfaces and/or may not provide the desired operation controls for a particular application.

Embodiments of the present invention include a device for displaying and illuminating an image, examples of which are provided below, that address the problems described above. The device includes a housing having an inner portion, and a viewing aperture formed in the housing. Also included is a light guide. The light guide includes a light source, and is configured to be removably received within the housing via the opening. The light guide is also configured to provide a guide surface, as will be described in further detail below.

A graphic medium that includes an image to be displayed and illuminated by the device is inserted and removed from the housing by way of the opening. The guide surface on the light guide acts to guide the graphic medium into a predetermined position. Once positioned, the image is viewable through the viewing aperture provided in the housing, and is illuminated by light originating from the light source of the light guide.

Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

Figure 1A:
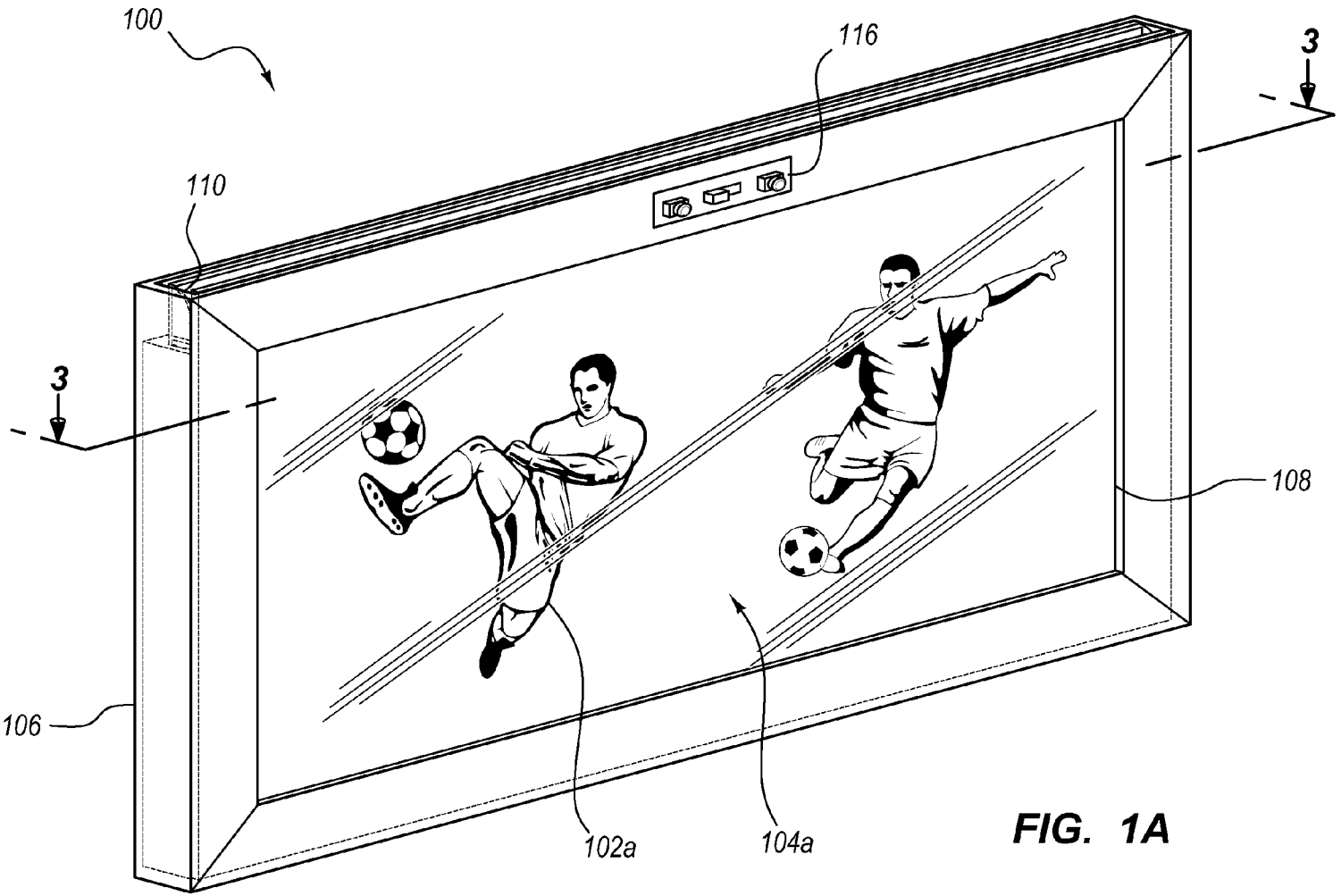
FIG. 1A illustrates an imaging device displaying an image.

FIG. 1A illustrates an imaging device 100 displaying an image 102*a* produced on a graphic medium 104*a*. The image may include a photograph, a tangible representation of a scene, object, art, or the like. The imaging device 100 is configured to receive the graphic medium 104*a* within a housing 106. The image 102*a* is visible through an aperture 108 in the housing 106 and may be illuminated. A wide range of images may be available, and a user may select an image that is to his or her liking. The graphic medium 104*a* provides a backing material on which the image 102*a* is imprinted. The graphic medium 104*a* may be a polymer backlit film, available from a variety of manufactures. However, other suitable graphic display materials may be used.

Figure 1B:
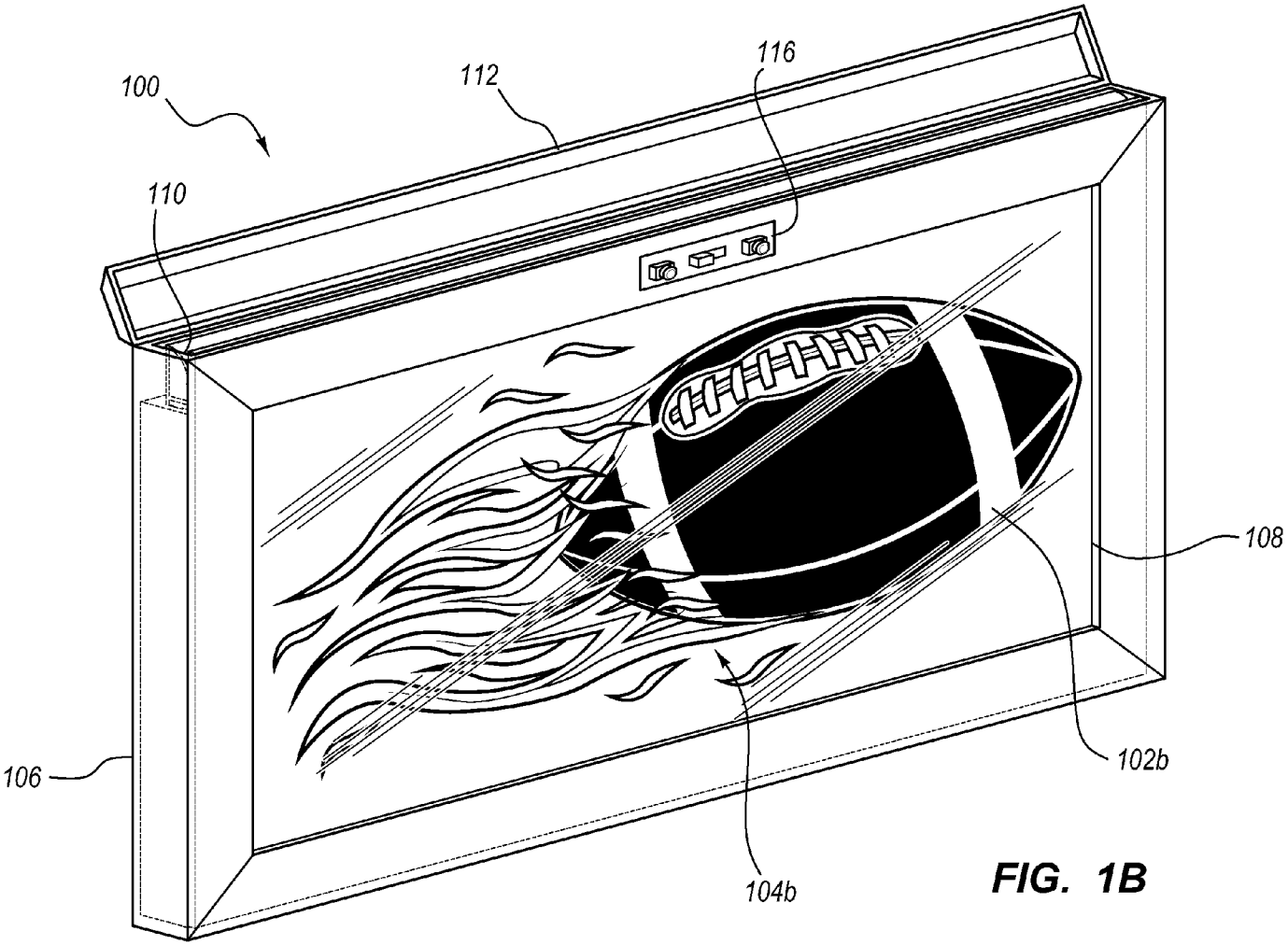
FIG. 1B illustrates the imaging device of FIG. 1A displaying a different image, and having a lid in an open position.

The imaging device 100 allows a user to easily insert or remove the graphic medium 104*a* through an opening 110. Thus, the user may change the graphic medium 104*a* received within the imaging device 100 in order to display another image. As illustrated in FIG. 1B, the imaging device 100 may be made to display a different image 102*b* produced on a different graphic medium 104*b*. The imaging device 100 may be made to display any number of different images and the image displayed may be changed as often as the user desires. In some embodiments, the imaging device 100 may include a lid 112 formed on the housing 106. A hinge may connect the lid 112 to the housing, or other configurations can be used to operably connect and/or interface the lid 112 with the housing 106.

In some embodiments, the opening 110 may be formed in one or more of the surfaces of the housing 106, including a top, bottom, front, back, and/or sides of the housing 106. In some embodiments, a portion of the housing may form a hinged access. The hinged access may allow the portion of the housing to be rotated away from the remainder of the housing 106 such that an opening may be formed and the graphic panel 104*b* may be changed. When the graphic panel 104*b* is changed, the hinged access portion may be rotated back to its display position. Other configurations may be used to provide access to the housing for insertion and retrieval of the imaging device and the graphic medium, and access does not necessarily need to be via an opening formed along an edge of the housing. For example, the housing 106 having an opening 110 may be located in a larger casing and a hinged, sliding, or other connection may allow the user to move part or all of the housing out of the casing to provide access to the opening.

A control panel 116 may be used to control the operation of imaging device 100. In certain embodiments, the control panel 116 may include membrane switches, touch-screen displays, and/or other control devices. Alternately or additionally, the control panel 116 may include a wireless control device enabling remote operation with a remote control. The wireless control device may include, for example, infrared (IR) or radio frequency (including but not limited to RF, WiFi®, and/or Bluetooth®) receivers. Alternately or additionally, the control panel 116 may connect to a computer network through a wired or wireless network connection enabling remote operation over the computer network and/or internet via a computer, tablet computer, mobile phone or other device enabled to communicate over a computer network and/or the internet. In some embodiments, the control panel may contain a motion sensor devised to turn on functions of the imaging device 100 when activated by someone entering the range of the motion sensor. The motion sensor may also be devised to deactivate functions of the imaging device 100 when motion has not been detected for a specified period of time. The control panel 116 may be located at the outside and/or inside of the housing 106 or lid 112.

The control panel 116 may be removably attached to the imaging device 100. For example, the control panel 116 may be removed to facilitate changing the graphic panel 104*b*. In some embodiments, part or all of the control panel 116 may attach to the imaging device 100 by a length of wired connector to allow part or all of the control panel 116 to be moved freely within the length of the wired connector. In some embodiments, controls attached to the imaging device 100 may override commands from the remote controls and may allow operation of the imaging device 100 when the remote controls are lost, not operational, or otherwise not convenient to use. The controls attached to the imaging device 100 may allow a user to perform more or fewer functions than a remote control. In some embodiments, an eye 217 in the housing 106 may accommodate the passing of a signal to the wireless control device; however, it should be appreciated that an eye will not be required for certain types of signals to reach the control panel. For example, in embodiments where an RF receiver is used, a suitable RF antenna would be provided, either as a separate antenna component (such as a strip antenna, not shown), or the antenna function can be provided by a metallic portion of the light guide 222 housing 242 (discussed below).

Figure 2A:
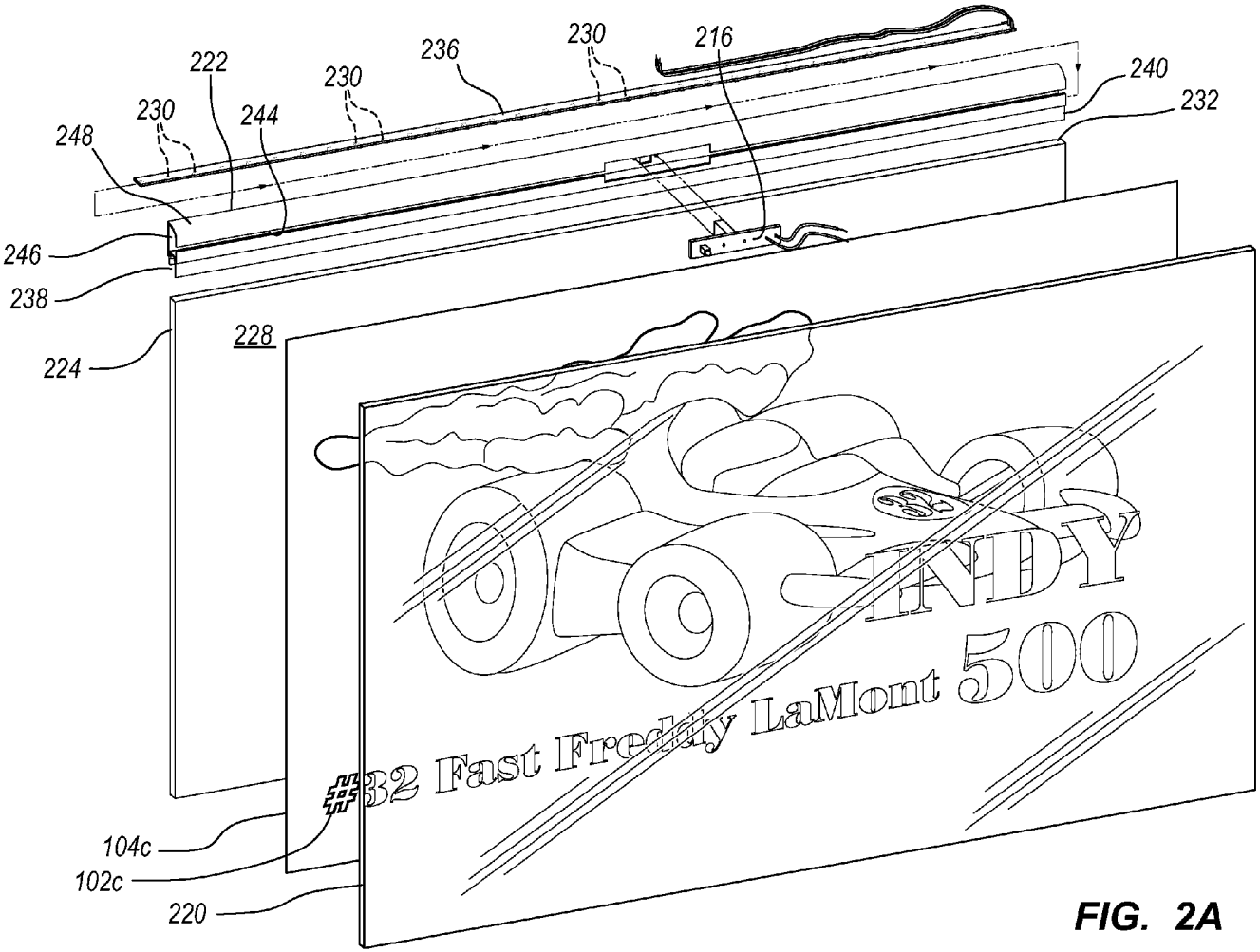
FIG. 2A illustrates an exploded perspective view of an imaging device with a housing omitted.
Figures 2B, 2C:
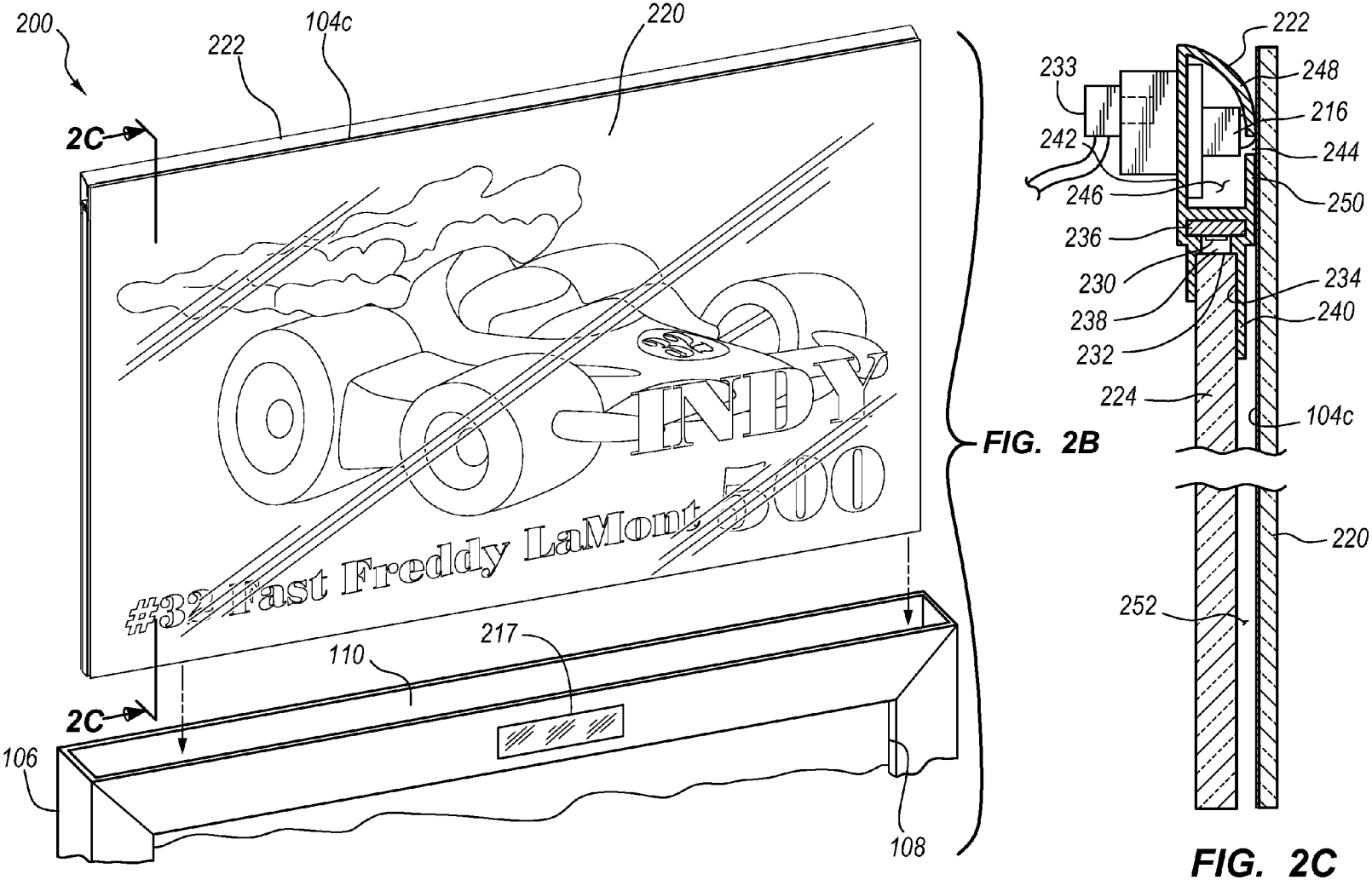
FIG. 2B illustrates a perspective view of the imaging device of FIG. 2A, with a housing separated from the remainder of the imaging device.
FIG. 2C illustrates a cross-sectional view of the imaging device of FIG. 2B with the housing omitted.

Referring to the embodiment disclosed in FIGS. 2A-2C, an imaging device may include a light source 230 retained by light guide 222 for illuminating the image 102*c*. In the illustrated embodiment, the light guide 222 is used in conjunction with a light distributing object, shown in FIGS. 2A-2C as a light guide panel 224, which may function to enhance distribution of light onto the image. The light guide panel 224 may enhance illumination of the image 102*c* by diffusing light originating from the light source 230 evenly over the face 228. The illuminating face 228 may be oriented towards the graphic medium 104*c* to provide illumination to the image 102*c*.

A light guide panel 224 designed to diffuse edge and/or corner lighting evenly over a face 228 of the light guide panel 224 may be made in a variety of sizes and configurations. The light guide panel 224 may be made from transparent acrylic sheets manufactured to diffuse varying amounts of light throughout the sheet. In some embodiments, the light guide panel 224 may be configured to diffuse light from multiple light guides 222 located at multiple edges and/or corners of the light guide panel 224. The diffusion values for a given location of the light guide panel 224 may be chosen so that at least one face 228 of the light guide panel 224 is uniformly illuminated when light is introduced to one or more edges and/or corners of the light guide panel 224.

Illumination of the image 102*c* may also be provided without a light guide panel 224. For example, the light guide 222 may be positioned so as to allow the light source 230 to provide illumination to the image 102*c* directly and/or by illumination reflected and/or diffused from the housing 106 or other surfaces. The light source 230 may include multiple light emitting diodes (LEDs). A power source, such as a 12 volt power source, may be utilized to power the LED light sources 230. Alternately or additionally, the light source 230 may include a fluorescent light panel, a cold cathode light panel, an electroluminescent panel, a neon tube, an incandescent bulb, and the like.

Referring to FIG. 2C, a power source 233 may provide electrical power from a standard outlet to the control panel 216 which in turn can control power provided to the light source 230. In some embodiments, the power source 233 may be removable from the control panel 216. The power source 233 may also be shaped to allow the imaging device 200 to be placed against a wall without damaging the power source 233. For example, wires may run substantially parallel to the wall where the power source 233 is inserted into the control panel. Other power sources may be used, including battery power, solar power, and the like.

As is shown in further detail in FIG. 2C, the light guide 222 may hold the light source 230 at an edge 232 of the light guide panel 224. In some embodiments, the light guide 222 may include a channel 234 to fit over an edge 232 of the light guide panel 224. As noted, in some embodiments, the light source 230 may include multiple light-producing device dispersed along the channel 234. The light source 230 may be arranged on a strip 236 located near the channel 234. A slot 238 in the channel 234 may allow light generated by the light source 230 to reach the edge 232 of the light guide panel 224. The slot 238 may run the length of the channel 234 to allow the strip 236 and light source 230 to be inserted into the light guide 222 during manufacture and/or servicing, as further illustrated in FIG. 2A. In this and other embodiments, a front wall 240 of the channel 234 may cover an extended area of the light guide panel 224 next to the light source 230 where the multiple light-producing devices may create uneven illumination resulting from the spaces between the individual light-producing devices. The light-producing devices may be held away from the edge 232 of the light guide panel 224 to allow light from the individual light-producing devices to spread before entering the light guide panel 224 to lessen any uneven illumination effects. In some embodiments, the light-producing devices are held about 1/64th of an inch away from the edge 232 of the light guide panel 224.

In some embodiments, the light guide housing 242 promotes heat dissipation so as to remain comfortable for a user to touch when the light source 230 has been producing heat for a significant amount of time. In one embodiment, the light guide housing 242 may be constructed at least partially of aluminum or anodized aluminum to promote heat transfer. To further promote heat dissipation, a break 244 may hinder conductive heat transfer from the light source 230 to a portion of the light guide housing 242 a user may access from the opening 110. In some embodiments, the break may allow heated air to escape a hollow portion 246 that is formed in the light guide 222. In some embodiments, heated air may also be allowed to escape from the ends of the light guide 222. The light guide housing 242 may also include thin walls to create a large surface area to promote heat transfer from the light guide 222 to the atmosphere. Alternately or additionally, other heat dissipation components may be used, such as fins, ridges, other heat emitting surface areas, openings, fans, or the like.

Referring to FIG. 2B, the imaging device 200 may include a transparent protective cover 220 located between the graphic medium 104*c* and the aperture 108. The protective cover 220 may protect the graphic medium 104*c* from scratching or other damage. In some embodiments, the protective cover 220 may be made from clear acrylic. However, other suitable materials are contemplated, including glass. The light guide panel 224 and light guide 222, graphic medium 104*c*, and protective cover 220 may be inserted into the housing 106 through the opening 110. Although shown as being formed at the top of the housing 106, in some embodiments, as previously discussed, the opening 110 may be formed at an edge of the housing 106, selectively covered with a lid 112, and/or formed by moving a portion of the housing 106. The graphic medium 104*c* may be located between the light guide panel 224 and the aperture 108. For embodiments including a protective cover 220, the protective cover 220 may be located between the graphic medium 104*c* and the aperture 108.

The graphic medium 104*c* may be removed and replaced with a different graphic medium as often as a user desires. In certain embodiments, the graphic medium 104*c* is inserted into the imaging device 200 after the light guide 222 and protective cover 220 have been received in the housing 106. Referring again to FIG. 2C, a guide surface 248 disposed on the light guide 222 may assist the insertion of the graphic medium 104*c* into the housing 106. The guide surface 248 may be curved, planar, or a combination of curved and planar surfaces. The guide surface 248 may alleviate difficulty a user may experience when inserting a thin, flexible graphic medium 104*c* into a narrow space. The shape of the guide surface 248 may allow a user to introduce the graphic medium 104*c* into a relatively wide opening and have the graphic medium 104*c* funneled into the space between the light guide 222 and protective cover 220. The configuration may further allow insertion and retrieval without the need for separate guide channels or tracks, which may be difficult to use with a non-rigid graphic medium 104*c*. In some embodiments, additional guide channels may be used, as is discussed further below. In some embodiments, the graphic medium 104*c* and protective cover 220 may be inserted into the imaging device 200 together. The graphic medium 104*c* may be permanently or temporarily affixed to the protective cover 220 or the graphic medium 104*c* and protective cover 220 may be separate. In embodiments where the graphic medium 104*c* and protective cover 220 are inserted together, the guide surface 248 and the housing 106 may act to funnel the graphic medium 104*c* and protective cover 220 into place.

In some embodiments, the imaging device 200 may facilitate insertion and removal of the graphic medium 104*c* by eliminating or reducing electrostatic buildup and attraction between the graphic medium 104*c*, protective cover 220 and light guide panel 224. This may be at least partially accomplished by a standoff provided by a front surface 250 of the light guide 222 and resulting gap or space 252 between the graphic medium 104*c* and the light guide panel 224, as is best seen in FIG. 2C. The space 252 may reduce friction and/or contact during insertion and removal, thereby reducing electrostatic buildup and binding that may result. In embodiments without the space 252 provided by the front surface 250, electrostatic attraction between the graphic medium 104*c*, light guide panel 224, and/or protective cover 220 may make the graphic medium 104*c* difficult to insert and/or remove. Alternately or additionally, insertion and/or removal may be facilitated by the shape of the guide surface 248. For example, the shape of the guide surface 248 may provide a user access to grip a top portion of the graphic medium 104*c*, which may eliminate the need for additional slots, tabs, or the like for facilitating insertion or removal. The imaging device 200 may also facilitate the independent removal of the light guide 222 with or without the light guide panel 224. The imaging device 200 may further facilitate the independent removal of the protective cover 220.

In some embodiments, the shape and size of the light guide 222, protective cover 220 and graphic medium 104*c* may act together to hold these components in place when inserted inside the housing 106, as best demonstrated by FIG. 2C. The light guide panel 224, graphic medium 104*c*, and protective cover 220 are positioned vertically as illustrated. However, the light guide panel 224, graphic medium 104*c*, and/or protective cover 220 may be held in the housing 106 at an angle off-vertical by a differently shaped light guide 222, front surface 250, and/or housing 106. In some embodiments, the configuration, including the shape and size of the light guide 222, light guide plate 224, protective cover 220 and graphic medium 104*c* may act together to allow the light guide 222, light guide plate 224, protective cover 220 and graphic medium 104*c* to be held in place in the housing 106 without additional components. For example, the light guide 222, light guide plate 224, protective cover 220 and graphic medium 104*c* may be retained within the housing 106 without the use of additional retainers such as tracks.

Figure 3:
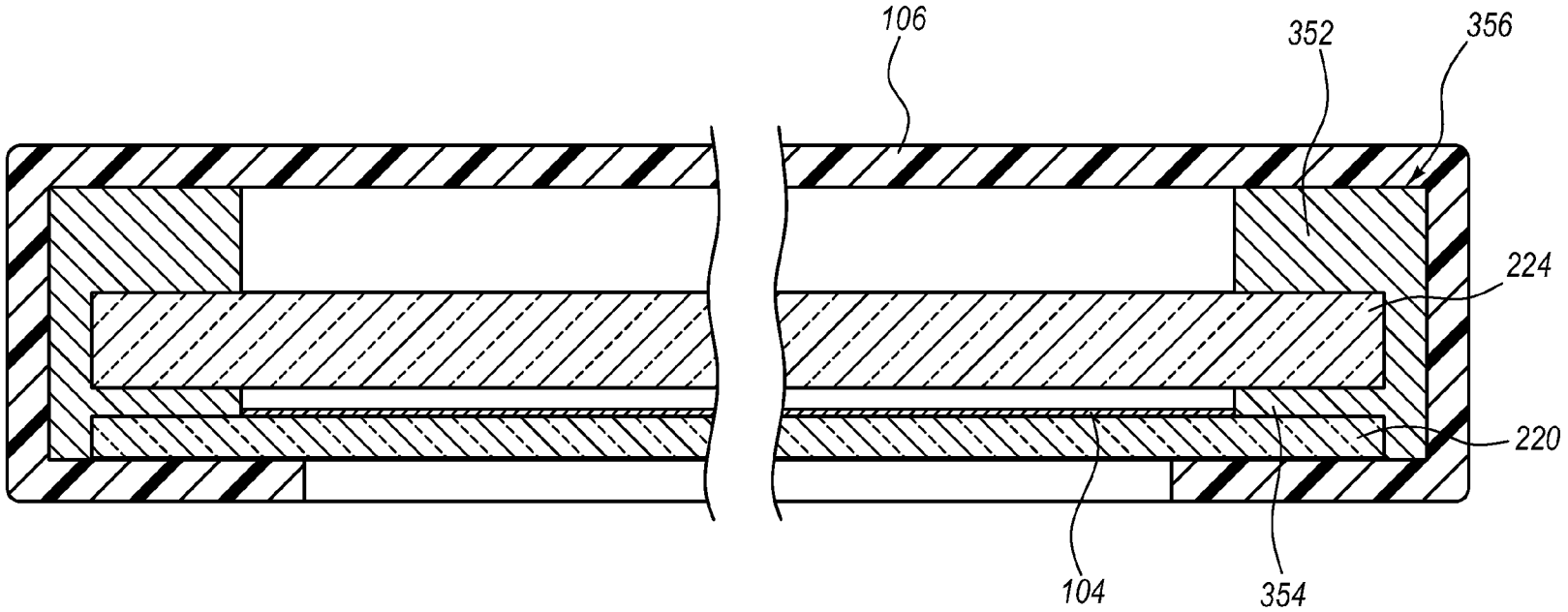
FIG. 3 illustrates a cross-sectional top view of the imaging device of FIG. 1A.

FIG. 3 illustrates a cross-sectional top view of the imaging device of FIG. 1A. The light guide panel 224, protective cover 220, and graphic medium 104 may be retained relative to one another and relative to the housing 106 by way of additional guide mechanisms. For example, a supplementary guide mechanism may be implemented via one or more tracks located within the housing. In some embodiments, a first track 352 and a second track 354 may retain the light guide panel 224. The second track 354 may also retain the graphic medium 104 and/or protective cover 220. The first track 352 and second track 354 may be formed on a track system 356. The track system 356 may be separate from the housing 106 and inserted and/or attached in the housing 106. Alternately or additionally, the track system may be located at the bottom of the cavity in the housing 106 and may be tapered to aid insertion of the light guide panel 224, graphic medium 104, and/or protective cover 220. In some embodiments, the track system 356 may be formed by the housing 106. In some embodiments, other suitable systems may be used to retain the light guide panel 224, graphic medium 104, and/or protective cover 220. In some embodiments, retainers may be attached to the light guide panel 224 and/or protective cover 220. Alternately or additionally, a retainer may include a removable panel.

Figure 4A:
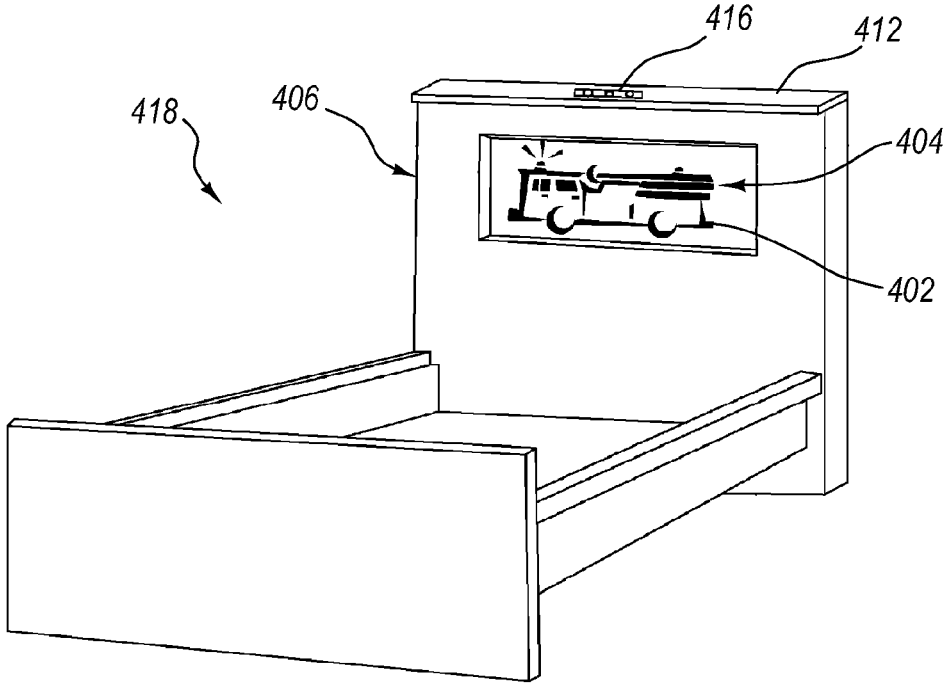
FIG. 4A illustrates a perspective view of a bed having a headboard enclosing an imaging device within a housing, and in which a lid of the housing is in a closed position.
Figure 4B:
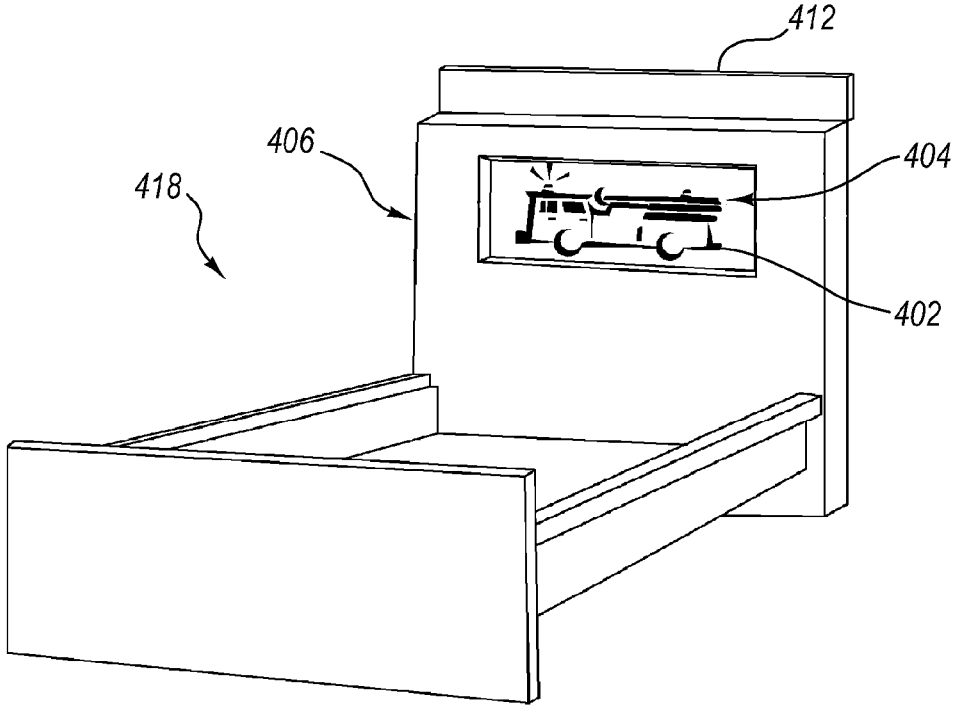
FIG. 4B illustrates a perspective view of the bed of FIG. 4A, in which the lid of the housing is in an open position.

FIGS. 4A and 4B illustrate a perspective view of one embodiment of a bed 418 having a headboard 406 enclosing an imaging device of the sort described above. As is shown, the imaging device is disposed within headboard 406. A graphic medium 404 having an image 402 is held in the imaging device. The image is visible through an aperture 408 in the headboard 406. Along the top edge, the headboard 406 includes a lid 412 shown in a closed position in FIG. 4A and in an open position in FIG. 4B. A user may open the lid 412 in order to remove or replace the graphic medium, the light guide, the light guide and/or the protective cover. A hinge, or other suitable connection mechanism, may connect the lid 412 to the headboard 406. A control panel 416 may be included to allow operation of the imaging device disposed within the headboard 406.

Figure 6:
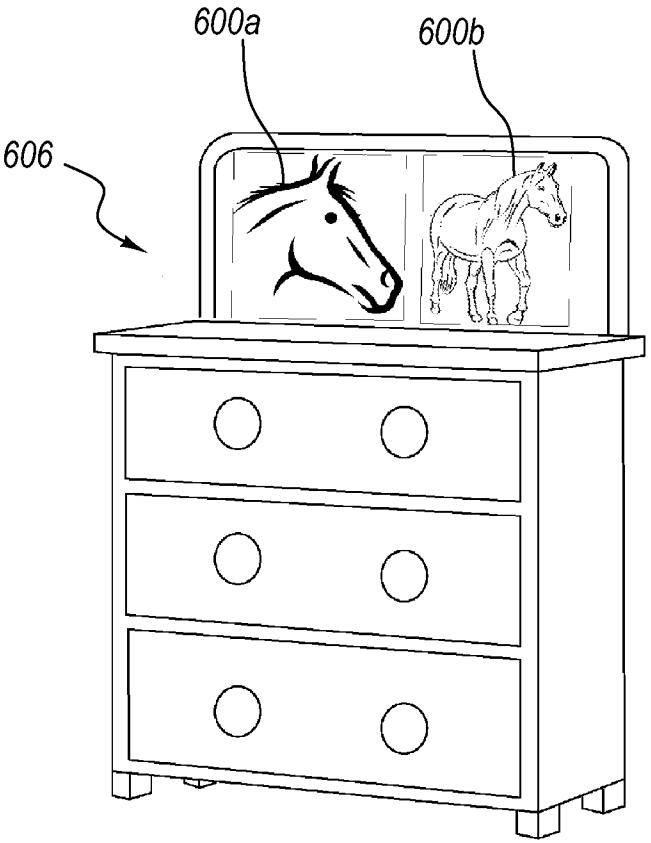
FIG. 6 illustrates a perspective view of a chest of drawers incorporating multiple imaging devices.
Figure 5:
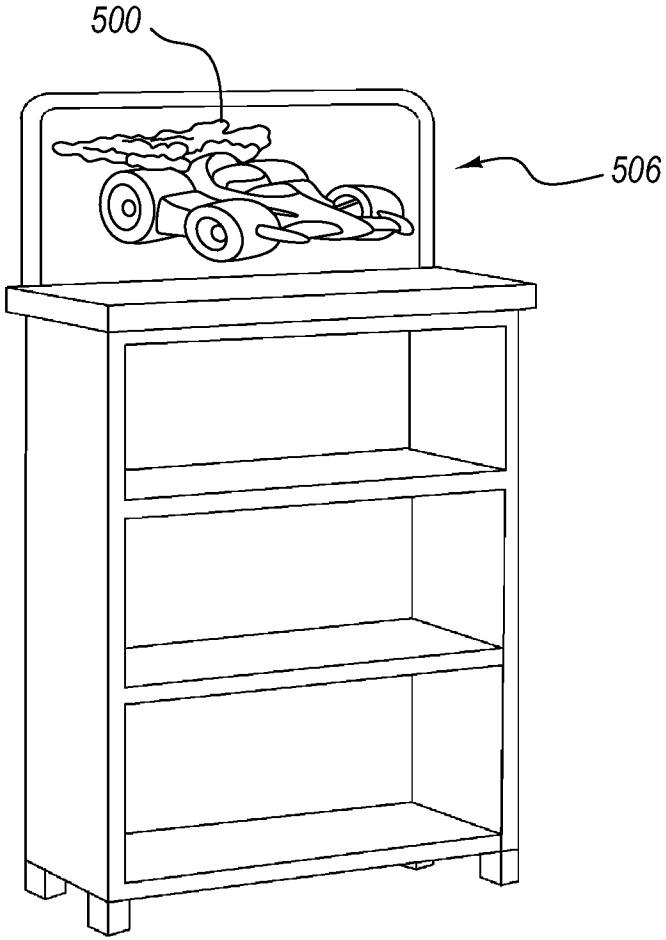
FIG. 5 illustrates a perspective view of a bookcase incorporating an imaging device with replaceable images.

The teachings of the present disclosure may be adapted to a wide variety of applications. By way of example, FIG. 5 illustrates a bookshelf 506 incorporating an imaging device 500. FIG. 6 illustrates a chest of drawers 606 incorporating two imaging devices 600*a* and 600*b*. In some embodiments, a single imaging device may be used with a plurality of graphic media simultaneously. For example, an imaging device might be configured to accept two or more graphic media so as to allow one or more of the graphic media to be exchanged independently. In other embodiments, the imaging device may be used in conjunction with a digital photo frame for displaying digitally changeable images. It is contemplated that an imaging device may also be attached to or incorporated into other articles of furniture, including but not limited to changing tables, cribs, toy chests, dressers, and benches.

Figure 7:
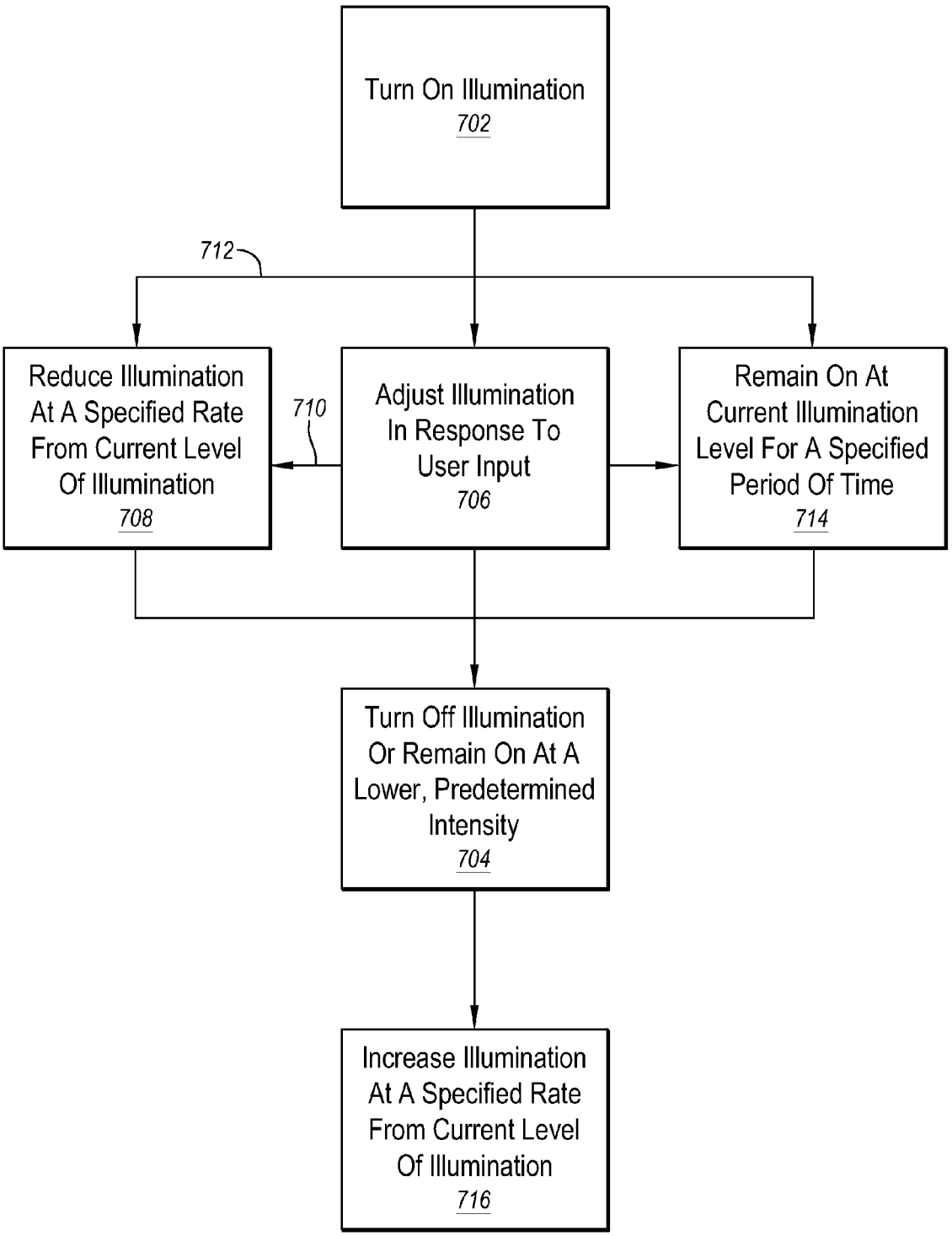
FIG. 7 illustrates a flowchart depicting an example illumination control method which may be implemented by the imaging devices of FIGS. 1A-6.

FIG. 7 illustrates a flowchart depicting an example illumination control method 700 which may be implemented by the imaging devices of FIGS. 1A-6, arranged in accordance with at least some embodiments described herein. Illumination control 700 may allow the illumination to be turned on 702 or off 704. Illumination control 700 may provide a dimmer function. The dimmer function may allow the intensity of the light source to be decreased to a desired level 706, and/or decreased automatically over a specified time interval 708 (e.g. 30 minutes). For example, the imaging device may be turned on when a child is going to sleep; the intensity of the light source may then decrease gradually over time and eventually turn off (or remain on at a lower, predetermined intensity) after the child has had sufficient time to fall asleep. The light source may be automatically dimmed from an already dimmed level 710 or from a state of full illumination 712. Illumination control 700 may also provide a timed shut-off function 714. The timed shut-off may allow the light source to remain on at a set intensity over a specified time interval and to turn off or dim and remain on at a lower, predetermined intensity after the specified time interval. Alternately or additionally, the imaging device may include an alarm clock, which may gradually increase the illumination provided by the light source at a specified time in order to wake a user 716.

In some embodiments, the imaging device may include one or more speakers and a music player or a docking system for a portable music player for playing music or producing white noise. In certain embodiments, the control panel allows a user to control the portable music player. It should be appreciated that the volume controls for the music player may function in substantially the same way as the illumination controls for the light source. In some embodiments, the volume controls may synchronize with the illumination controls. For example, as the light source automatically reduces at a specified rate, the volume may also reduce at a specified rate to turn off before, after, or at the same time the illumination is turned off or reaches a lower, predetermined intensity. The volume controls may function independently of the illumination controls. For example, the illumination may increase gradually to wake a user and if the alarm clock function is not shut off before the light source reaches full illumination, music may turn on to ensure the user wakes.

Figure 8:
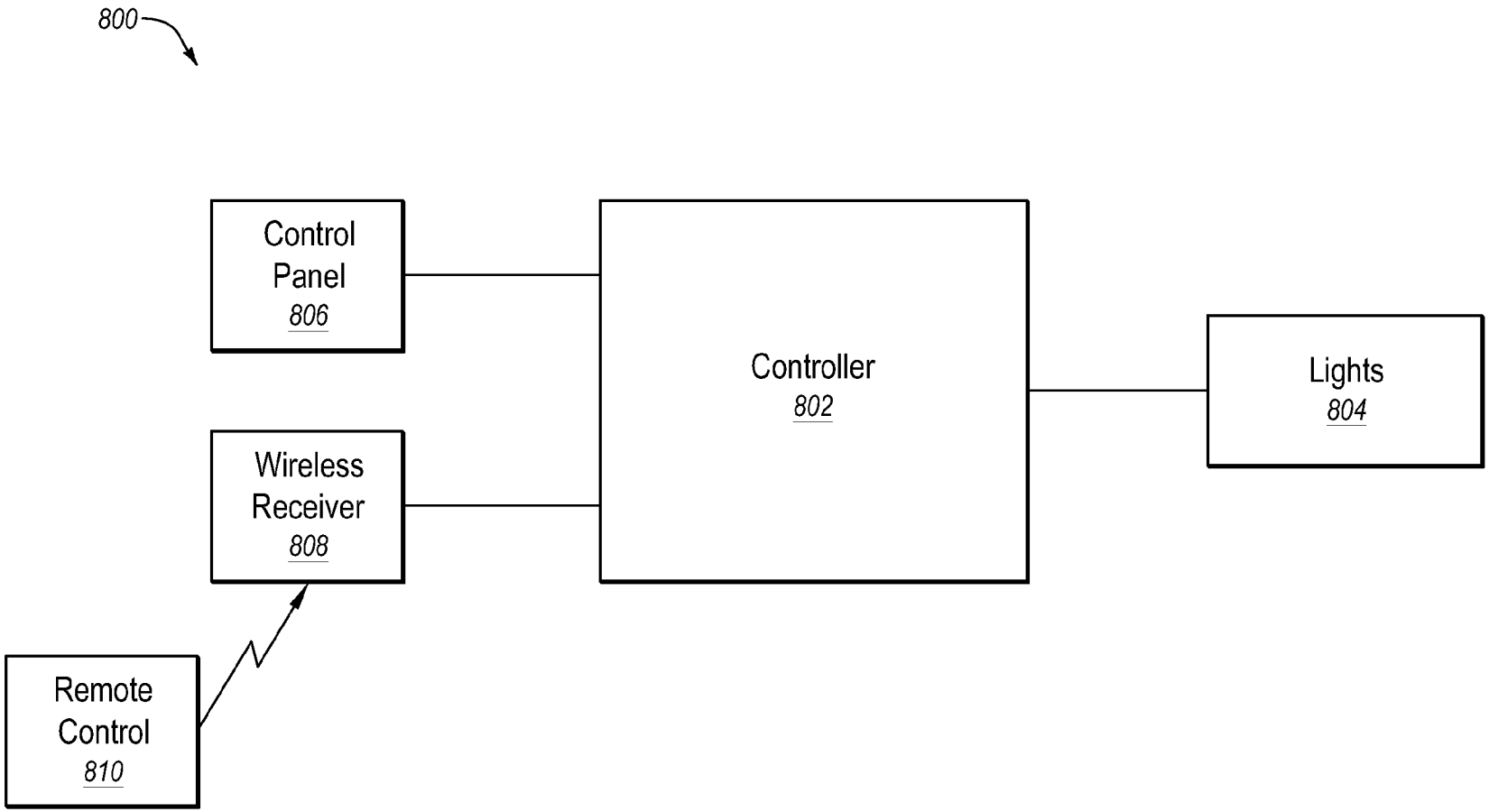
FIG. 8 illustrates a block diagram of an illumination control system which may implement the illumination control method of FIG. 7.

FIG. 8 illustrates a block diagram of an illumination control system 800 which may implement the illumination control method of FIG. 7, arranged in accordance with at least some embodiments described herein. The illumination control system 800 may include a controller 802. In some embodiments, the controller 802 may include a programmable microcontroller unit. The controller may control the operation of the lights 804 based on instructions received from the control panel 806 and/or a remote control 810 via a wireless receiver 808. The lights 804 may generally correspond to the light source 230 described with reference to FIGS. 2A-2C. The control panel 806 and/or wireless receiver 808 may generally correspond to the control panel 116 described with reference to FIGS. 1A and 1B. Operation of the lights may generally correspond to the illumination control method 700 described with reference to FIG. 7. In some embodiments, the controller 802 may operate a switch or other device to allow and/or interrupt power to the lights 804 and thus turn the lights 804 on and off. The controller 802 may further operate a dimmer to adjust the intensity of the lights 804. Alternately or additionally, the controller 802 may cycle power to the lights 804 to create an appearance that the lights 804 are dimmed. The controller 802 may include a timer function, which may be used to turn the lights 804 on or off after a period of time, and/or adjust the intensity of the lights 804 over a period of time.

Figure 9:
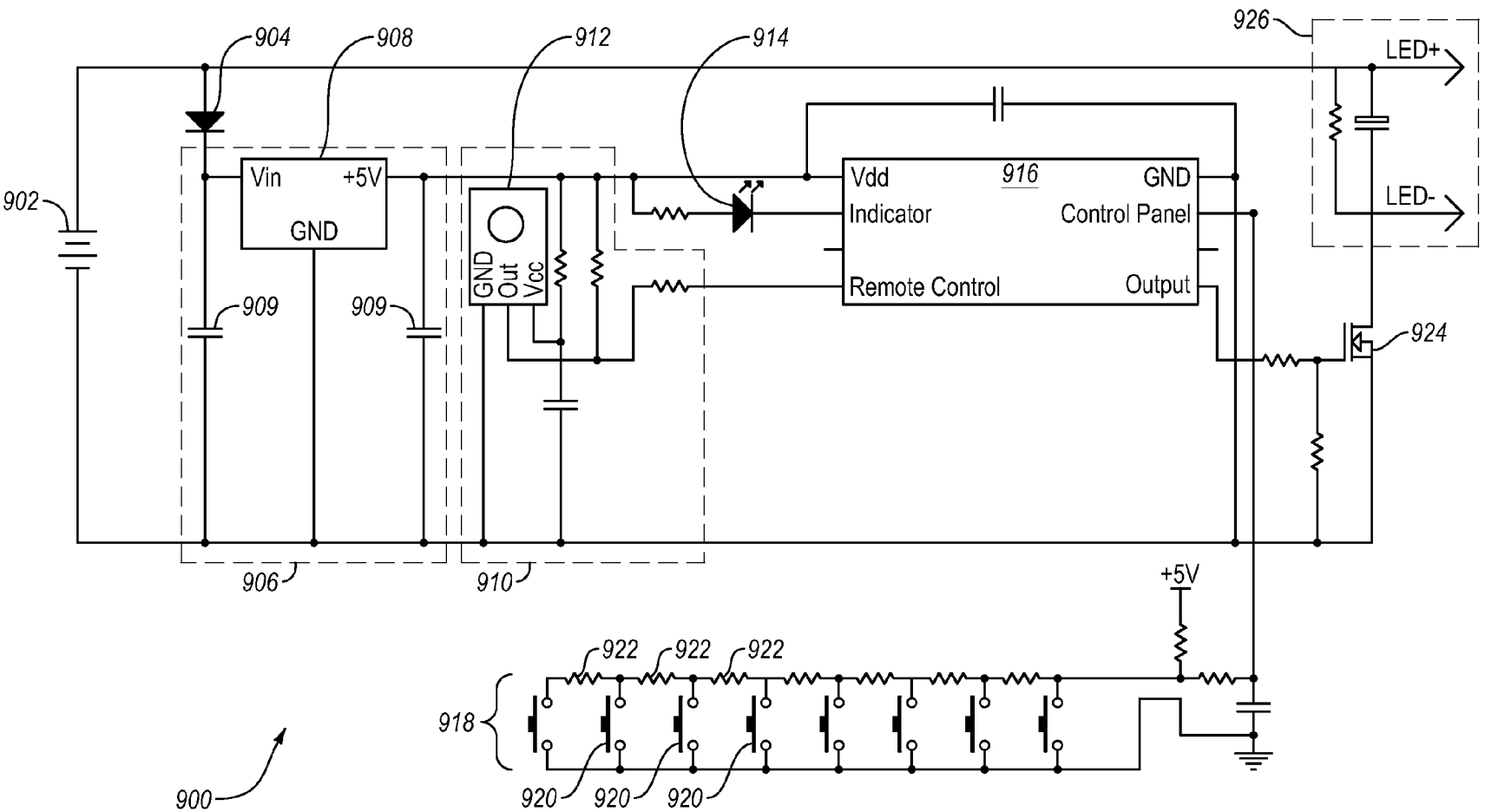
FIG. 9 illustrates a circuit diagram of an illumination control system which may implement the illumination control method of FIG. 7.

FIG. 9 illustrates a diagram of an illumination control circuit 900 which may implement the illumination control method of FIG. 7, arranged in accordance with at least some embodiments described herein. The illumination control circuit 900 may include a 12-volt power source 902. In some embodiments, the illumination control circuit 900 may include a diode 904. A voltage regulator circuit 906 may include a 5-volt voltage regulator 908, and capacitors 909 to provide a fixed output voltage.

The illumination control circuit 900 may include a wireless receiver circuit 910. The wireless control circuit 910 may include a wireless receiver 912. For example, an IR wireless receiver. The wireless control circuit 910 may receive wireless signals at the wireless receiver 912 and send converted signals to a microcontroller unit 916.

The illumination control circuit 900 may also include a control panel circuit 918. The control panel circuit 918 may include multiple switches 920. In some embodiments, the switches 920 are momentary, normally open switches. The control panel circuit 918 may include resistors 922 arranged such that a different signal is provided at the microcontroller unit 916 when each switch 920 is pressed.

The microcontroller unit 916 may be programmed to output a signal to the gate of a transistor 924. In some embodiments, the transistor 924 may be an n-channel, depletion, metal oxide semiconductor field-effect transistor (MOSFET). The signal may control the LED circuit 926 by selectively interrupting and/or allowing power to the LED circuit 926. In some embodiments, the microcontroller unit 916 may control the intensity of the light output of the LEDs by outputting a signal such that the LEDs are cycled on and off at a high frequency. The LEDs may be cycled on and off at a high enough frequency that the LEDs appear to be dimmed to a human observer. The intensity of the light output may be controlled by varying the length of time the LEDs are on compared to the length of time the LEDs are off during each on/off cycle.

The illumination control circuit 900 may include an indicator LED 914. The indicator LED 914 may provide a user with feedback about the illumination control circuit 900. For example, the LED 914 may indicate that the illumination control circuit 900 is receiving power and/or that input was received via the control panel circuit 918 or wireless receiver circuit 910.

Figure 10:
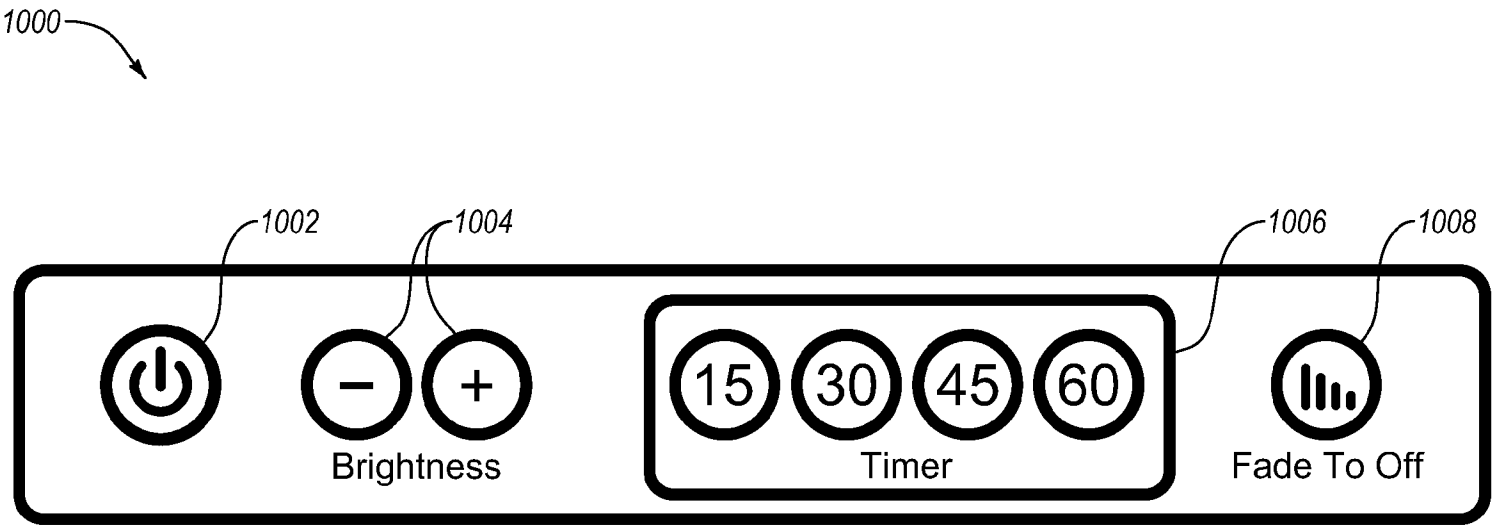
FIG. 10 illustrates a control panel which may be used with the systems of FIGS. 8 and/or 9 to allow the illumination control method of FIG. 7, all arranged in accordance with at least some embodiments described herein.

FIG. 10 illustrates a control panel 1000 which may be used with the systems of FIGS. 8 and/or 9 to allow the illumination control method of FIG. 7, arranged in accordance with at least some embodiments described herein. The control panel 1000 may generally correspond to the control panel 116 of FIGS. 1A and 1B, and/or the control panel 806 of FIG. 8, and/or the control panel circuit 918 of FIG. 9. By way of example and not limitation, the control panel may include membrane and/or capacitive switches. The control panel 1000 may be used to control a light source of an imaging device generally corresponding to the imaging devices described with reference to FIGS. 1A-6. The control panel 1000 may include an on/off control 1002. The control panel 1000 may also include a brightness control 1004 for increasing and/or decreasing the intensity of the light source. In some embodiments, the control panel 1000 may include timer controls 1006. As illustrated, the timer controls 1006 include preset time intervals of 15, 30, 45, and 60 minutes. However, in some embodiments, the timer controls 1006 may allow other time intervals to be set. The control panel 1000 may include a fade to off control 1008. In some embodiments, the fade to off control 1008 may be toggled between active and inactive. When a timer control 1006 is selected and the fade to off control 1008 is inactive, the light source may turn off after the selected time interval has elapsed. When a timer control 1006 is selected and the fade to off control 1008 is active, the light source may dim over the selected time interval and turn off after the selected time interval has elapsed.

By way of summary, disclosed embodiments are directed to an illumination system that provide a number of features and advantages over the prior art. For example, by incorporating a thermal management system (heat sink); transparency guide; electrostatic "break"; wire chase; dimmer and timer control that can be remotely operated; alternate "touch" switch; LED light strip holder; and 12 v DC electrical connection into a single, light guide, a new approach to a removable and controlled method and system of backlighting/illumination is provided. Such a system enables LED backlighting to be incorporated into applications, lighting systems and furnishings in a way heretofore impractical and/or impossible, such as a children's bed, other furniture and under-cabinet and under-counter commercial and residential lighting. Disclosed features include: (1) System design and framing methodology enabling easy removal (slidingly removable) of all elements of a backlighting/illumination system for ease of installation, change, servicing and repair; (2) "frameless" backlighting system enabling incorporation into "exterior frames", requiring no separate addition or framed attachment of heat sink, and facilitating change of components independently; (3) unique extruded light guide panel/cap design—in function, form and size—enabling, for example, heat management and transfer of heat generated by LED (or similar) lighting in an enclosure; easy insertion/change of transparency utilizing rounded (bull-nosed) edge at insertion point of transparency to guide the transparency and provide an air gap to minimize electrostatic binding of plastic components upon insertion; incorporation of controller comprised of dimmer/timer/IR or RF (Bluetooth) receiver (for remote control) and separate membrane and/or capacitance touch control; containment in an integral "chase" of wiring from LED light strip to controller; and incorporation of wiring harness with removable plugs to facilitate light guide panel removal.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present inventions have been described in detail, it should be understood that the various changes, substitutions, and alterations could be made hereto without departing from the spirit and scope of the invention.

What is claimed is:

1. A device suitable for displaying and illuminating images, the device comprising:

a housing comprising an interior portion;

an opening providing access to the interior portion;

a viewing aperture formed in the housing;

a light guide comprising a light source, the light guide configured to be removably received within the housing via the opening; and an image imprinted on a graphic medium, the graphic medium is configured to be removeably received within the housing via the opening; and a guide surface disposed on a portion of the light guide, the guide surface configured to guide the graphic medium to a position wherein at least a portion of the image is viewable through the viewing aperture and at least a portion of the image is at least partially illuminated via light originating from the light source.

2. The device of claim 1, wherein the housing forms a portion of an article of furniture.

3. The device of claim 2, wherein the portion of the article of furniture comprises a portion of a headboard for a bed.

4. The device of claim 1, further comprising a protective cover configured to be removably received within the housing via the opening and in a manner to substantially cover the image imprinted on the graphic medium.

5. The device of claim 1, further comprising a light guide panel configured to distribute the light originating from the light source to illuminate the at least a portion of the image.

6. The device of claim 5, wherein the light guide panel comprises an edge configured to receive light from the light source, wherein the light guide panel is configured to distribute light entering the edge to a face of the light guide panel.

7. The device of claim 5, wherein the light guide is configured to provide a space between the light guide panel and the graphic medium.

8. The device of claim 5, further comprising one or more retaining mechanisms configured to removably receive at least one of the graphic medium and the light guide panel.

9. The device of claim 1, wherein the light source comprises a plurality of light emitting devices disposed along a length of the light guide.

10. The device of claim 1, further comprising a control device configured to allow manipulation of one or more functions of the light source.

11. The device of claim 10, wherein the control device further comprises a dimmer function which allows the intensity of the light emitted by the light source to be changed to a desired level.

12. The device of claim 11, wherein the controller is configured to change the intensity of the light a desired level over a predetermined period of time.

13. The device of claim 11, wherein the controller is configured to decrease the intensity of the light from a desired level to off over a predetermined period of time.

14. An article of furniture, comprising:

a housing having an interior portion accessible via an opening formed along a portion of the housing;

an image imprinted on a graphic medium, the graphic medium configured to be received within the housing via the opening and in a manner such that at least a portion of the image is viewable through a viewing aperture formed in the housing;

a light guide having a plurality of light emitting devices; and a light guide panel configured to direct light emitted from the plurality of light emitting devices onto the image;

wherein the light guide is configured to be removeably received within the housing via the opening; and a guide surface provided on the light guide, the guide surface oriented to guide the graphic medium within the housing and retain the graphic medium in a predetermined position and orientation within the housing, the guide surface being further configured to provide a space between at least a portion of the graphic medium and the light guide panel.

15. The article of furniture of claim 14, wherein the housing forms a portion of a headboard for a bed.

16. The article of furniture of claim 14, further comprising a dimmer control mechanism that allows the intensity of the illumination to the image to be changed to a desired level.

17. The article of furniture of claim 16, wherein the dimmer control mechanism is operable such that the intensity of the illumination is decreased from a desired level to off over a predetermined period of time.

18. The article of furniture of claim 14 further comprising a protective cover configured to be received within the housing via the opening and in a manner to substantially cover the image imprinted on the graphic medium.

19. A light guiding device comprising:

a substantially planar light guide panel;

a light guide including a light source positioned so as to direct light to the light guide panel for illumination of an image, the light guide further including a guiding structure comprising a guide surface configured to retain the light guide panel at a position that is at least partially offset from the image.

20. The device of claim 19, wherein the guiding structure further comprises a retention channel configured to receive and retain an edge of the light guide panel, the edge receiving light from the light source.

* * * * *